US009789521B2

(12) United States Patent
Minichmayr et al.

(10) Patent No.: US 9,789,521 B2
(45) Date of Patent: Oct. 17, 2017

(54) ROLLING STAND FOR PRODUCING ROLLED STRIP

(75) Inventors: Robert Minichmayr, Enns (AT); Alois Seilinger, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 220 days.

(21) Appl. No.: 13/515,069

(22) PCT Filed: Nov. 4, 2010

(86) PCT No.: PCT/EP2010/066776
§ 371 (c)(1),
(2), (4) Date: Sep. 21, 2012

(87) PCT Pub. No.: WO2011/069756
PCT Pub. Date: Jun. 16, 2011

(65) Prior Publication Data

US 2013/0008220 A1 Jan. 10, 2013

(30) Foreign Application Priority Data

Dec. 10, 2009 (AT) ..... A 1955/2009

(51) Int. Cl.
*B21B 13/14* (2006.01)
*B21B 27/02* (2006.01)

(52) U.S. Cl.
CPC ..... *B21B 13/142* (2013.01); *B21B 27/021* (2013.01); *B21B 2267/18* (2013.01); *B21B 2269/12* (2013.01)

(58) Field of Classification Search
CPC ..... B21B 13/02; B21B 13/14; B21B 13/142; B21B 27/02; B21B 27/021
(Continued)

(56) References Cited

U.S. PATENT DOCUMENTS 3,387,470 A * 6/1968 Smith, Jr. ..... B21B 37/28 700/154
4,519,233 A * 5/1985 Feldmann ..... B21B 13/147 72/241.4
(Continued)

FOREIGN PATENT DOCUMENTS

CN 87 1 04310 A 2/1988
CN 1555297 A 12/2004
(Continued)

OTHER PUBLICATIONS

International PCT Search Report, PCT/EP2010/066776, 4 pages, Apr. 12, 2011.
(Continued)

*Primary Examiner* — James S McClellan
*Assistant Examiner* — Peter Iannuzzi
(74) *Attorney, Agent, or Firm* — Ostrolenk Faber LLP

(57) ABSTRACT

A rolling stand is provided for producing a rolled strip having working rolls which are supported on supporting rolls or intermediate rolls and supporting rolls, wherein the working rolls and/or intermediate rolls and/or supporting rolls are arranged in the rolling stand so as to be displaceable axially relative to one another, and each roll of at least one roll pair formed from a supporting roll and a working roll or from a supporting roll and an intermediate roll has a curved contour which runs over the entire effective barrel length, wherein the contour of the supporting roll is predefined by a contour function which is formed from a superposition of a first contour function, which runs in a manner complementary to the adjacent working roll in a non-displaced state, with a superposition function which is concave or convex in relation to the supporting roll axis.

26 Claims, 2 Drawing Sheets

(58) Field of Classification Search
USPC ..... 72/241.2, 243.6, 252.5
See application file for complete search history.

(56) References Cited

U.S. PATENT DOCUMENTS

| | | | | | |
|---|---|---|---|---|---|
| 4,781,051 | A * | 11/1988 | Schultes | B21B 13/142 492/1 |
| 4,798,074 | A | 1/1989 | Feldmann et al. | 72/247 |
| 4,800,742 | A * | 1/1989 | Feldmann | B21B 13/142 492/1 |
| 4,805,433 | A * | 2/1989 | Rennebaum | B21B 13/147 72/242.4 |
| 4,881,396 | A * | 11/1989 | Seidel | B21B 13/142 492/1 |
| 5,622,073 | A * | 4/1997 | Hiruta | B21B 13/142 72/247 |
| 6,119,500 | A * | 9/2000 | Ginzburg | B21B 37/40 72/10.1 |
| 8,413,476 | B2 * | 4/2013 | Seilinger | B21B 13/142 72/241.2 |
| 8,881,569 | B2 * | 11/2014 | Seilinger | B21B 13/142 72/240 |
| 2005/0034501 | A1 * | 2/2005 | Seilinger | B21B 37/40 72/252.5 |

FOREIGN PATENT DOCUMENTS

| | | | | | |
|---|---|---|---|---|---|
| CN | 101466483 | A | | 6/2009 | |
| CN | 101511498 | A | | 8/2009 | |
| DE | 2736233 | A | * | 2/1978 | |
| DE | 2736233 | A1 | * | 2/1978 | B21B 37/30 |
| DE | 3602698 | A1 | | 10/1986 | B21B 29/00 |
| DE | 3620197 | A1 | | 12/1987 | |
| EP | 0091540 | A1 | | 10/1983 | |
| EP | 0258482 | A1 | | 9/1986 | B21B 13/14 |
| EP | 0249801 | A1 | | 6/1987 | B21B 13/14 |
| JP | 61-092704 | | | 5/1986 | |
| JP | 61092704 | A | | 5/1986 | B21B 1/24 |
| JP | 2571845 | B2 | * | 1/1997 | B21B 13/14 |
| WO | 03/022470 | A1 | | 3/2003 | B21B 13/14 |
| WO | WO 03/022470 | A1 | | 3/2003 | |
| WO | 2007/144161 | A1 | | 12/2007 | B21B 13/14 |
| WO | 2007/144162 | A1 | | 12/2007 | B21B 13/14 |
| WO | WO 2007144161 | A1 | * | 12/2007 | B21B 13/142 |
| WO | WO 2007144162 | A1 | * | 12/2007 | B21B 13/142 |

OTHER PUBLICATIONS

Notice of Opposition issued in European counterpart patent No. EP2509723 dated Jul. 13, 2015.

* cited by examiner

ROLLING STAND FOR PRODUCING ROLLED STRIP

CROSS-REFERENCE TO RELATED APPLICATIONS

This application is a U.S. National Stage Application of International Application No. PCT/EP2010/066776 filed Nov. 4, 2010, which designates the United States of America, and claims priority to AT Patent Application No. A1955/2009 filed Dec. 10, 2009, the contents of which are hereby incorporated by reference in their entirety.

TECHNICAL FIELD

The disclosure relates to a rolling stand for producing rolled strip having working rolls which are supported on supporting rolls or intermediate rolls and supporting rolls, wherein the working rolls and/or intermediate rolls and/or supporting rolls are arranged in the rolling stand so as to be displaceable axially relative to one another, and each roll of at least one roll pair formed from a supporting roll and a working roll or from a supporting roll and an intermediate roll has a curved contour which runs over the entire effective barrel length.

BACKGROUND

WO 2007/144162 A1 discloses a rolling stand in the case of which the barrel contour of the rolls is described by a trigonometric function. In the non-loaded state, a partial or complete supplementation of the barrel contour of the supporting rolls and of the directly adjacent working rolls or of the intermediate rolls occurs. In the case of the rolling stand known from WO 2003/022470 A1, too, the barrel contour follows a trigonometric function.

In the case of very wide rolling stands, however, it has been found in practice that high pressures occur, particularly when rolling wide strips and under a high level of loading, in the marginal regions of the rolls. This effect is undesirable and is intensified with an increasing working roll diameter, and also by the use of roll bending. This problem is not limited to a specifically formed camber of the rolls, but rather also arises in principle in the case of rolls with a conventional camber.

SUMMARY

In one embodiment, a rolling stand is provided for producing rolled strip having working rolls which are supported on supporting rolls or intermediate rolls and supporting rolls, wherein the working rolls and/or intermediate rolls and/or supporting rolls are arranged in the rolling stand so as to be displaceable axially relative to one another, and each roll of at least one roll pair formed from a supporting roll and a working roll or from a supporting roll and an intermediate roll has a curved contour which runs over the entire effective barrel length, characterized in that the contour of the supporting roll is predefined by a contour function which is formed from a superposition of a first contour function, which runs in a manner complementary to the adjacent working roll in a non-displaced state, with a superposition function which is concave or convex in relation to the supporting roll axis.

In a further embodiment, the contour function of the supporting roll is formed by subtraction of the first contour function and of the concave superposition function. In a further embodiment, the contour function of the supporting roll is formed by addition of the first contour function and of the convex superposition function. In a further embodiment, the first contour function is formed from contour portions which are alternately concavely and convexly curved, as seen in the barrel direction, wherein the contour function is described by a trigonometric function. In a further embodiment, the first contour function is formed from contour portions which are alternately concavely and convexly curved, as seen in the barrel direction, wherein the contour function is described by a polynomial function. In a further embodiment, the superposition function is formed by a function which is monotonic on both sides and symmetrical with respect to the barrel center. In a further embodiment, the superposition function is formed by a polynomial function. In a further embodiment, the superposition function is formed by a trigonometric function. In a further embodiment, the superposition function is formed by a circular function. In a further embodiment, the superposition function is formed by a power function. In a further embodiment, the contour of the supporting roll has a marginal chamfer in each case in the marginal region thereof.

In a further embodiment, the contour of the supporting roll is formed in accordance with the equation $$R_U(x, c) = R_0 + A * \sin\left(\frac{2 * \varphi * (x + c)}{L_{REF}}\right) - B * x - C * x^2$$

$$R_L(x, c) = R_0 - A * \sin\left(\frac{2 * \varphi * (x - c)}{L_{REF}}\right) + B * x - C * x^2$$

where $R_U$ radius of the upper supporting roll
$R_L$ radius of the lower supporting roll
x axial position with respect to the roll center
c contour displacement
$R_o$ roll radius offset
A contour coefficient
$\phi$ contour angle
$L_{REF}$ camber reference length
B tilting coefficient
C second order coefficient (C>0).

BRIEF DESCRIPTION OF THE DRAWINGS

Example embodiments will be explained in more detail below with reference to figures, in which.

DETAILED DESCRIPTION

Figure 1:
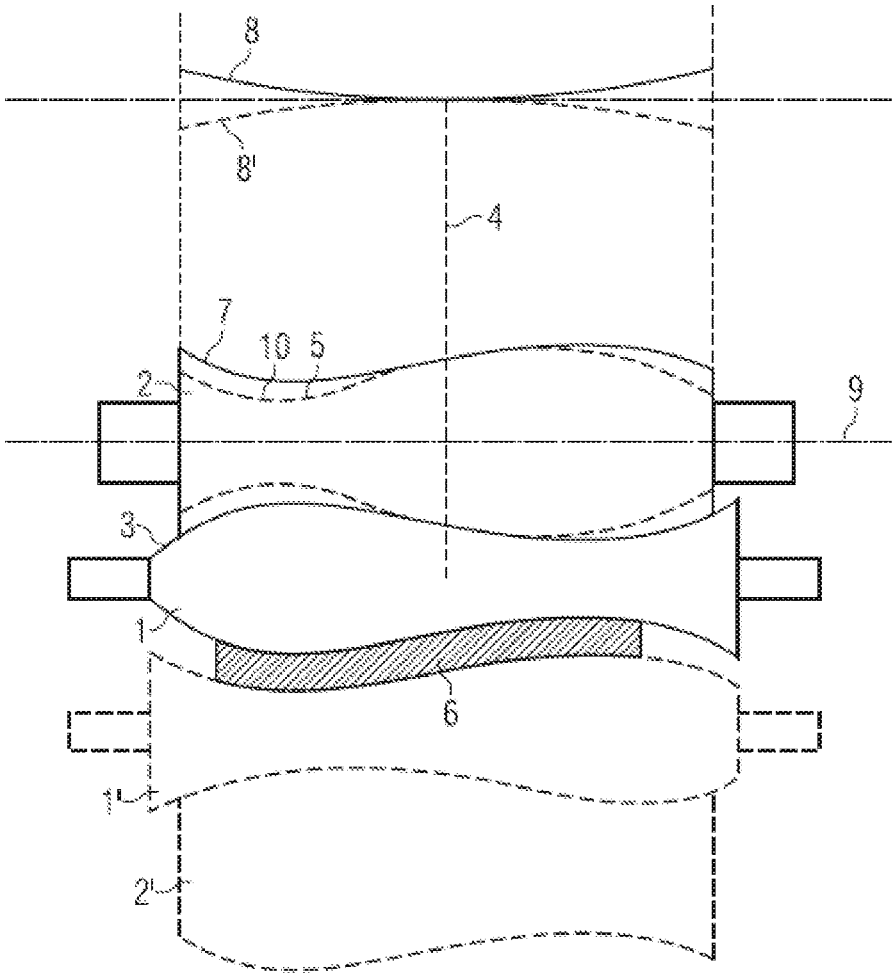
FIG. 1 is a schematic illustration showing an upper part of a four-high rolling stand, which shows a contour of a supporting roll which has arisen from a superposition in which a superposition function which is concave in relation to the supporting roll axis has been subtracted from, or a superposition function which is convex in relation to the supporting roll axis has been added to, a first contour function which runs in a manner complementary to the adjacent working roll.

Some embodiments provide a rolling stand in which, for example when a wide rolled strip is produced and rolled under a high level of loading, the maximum pressures acting on the working roll and supporting roll are lower, such that roll lives can be increased and roll breakages can be avoided as far as possible.

Some embodiments feature an additional formation of a convex curvature on a supporting roll having a curved contour which is known per se, i.e., the deliberate increase in the diameter of this roll in a central region. This additional curvature can be produced in such a way that a superposition function is superposed in the camber of the rolls, proceeding from a first contour function which runs in a manner complementary to the adjacent working roll. This superposition function can run convexly or concavely in relation to the supporting roll axis, depending on whether it is subtracted or added. This superposition has the effect that a convex curvature is formed in the center of the supporting roll, and therefore, in the non-loaded state, there is no longer complementary supplementation of adjacent rolls, but rather a progressively increasing gap is formed in the direction of the margin of the rolls. The symmetry of the load distribution is retained even so. The additionally formed curvature makes the load between the supporting roll and the directly adjacent roll (working roll or intermediate roll) more uniform. In other words, the pressure distribution between the supporting roll and the adjacent roll is made more uniform by the supporting roll contour formed as disclosed herein. Linear load peaks are reduced. As a result of this, the risk of cracking or even roll breakage is lower. The roll life is higher. A gap to the adjacent roll which increases outward in the non-loaded state is formed in the regions lying outside the center by virtue of the formation of the supporting roll contour as described herein. This has the further effect that the action of the roll bending is enhanced. The profile and surface evenness of the rolled strip can thereby be controlled more effectively during production.

In one embodiment, a superposition function which is concave in relation to the supporting roll axis is subtracted from the first contour function. In the camber of the rolls, this subtraction can be realized very easily.

In an alternative embodiment, during the production of the contour of the supporting roll, a superposition function which is convex in relation to the supporting roll axis is added to the first contour function. Here, too, the desired thickened portion is produced in the barrel center of the supporting roll.

In one embodiment, the first contour function is formed from contour portions which are alternately concavely and convexly curved, as seen in the barrel direction, wherein the contour function is described by a trigonometric function. As a result, the desired additional convex curvature in the barrel center of the supporting roll can be realized very easily in the case of rolls with a trigonometric contour mentioned in the introduction Background.

In one embodiment, the first contour function is formed by a polynomial function.

In another embodiment, provision can be made for the superposition function to be formed by a function which is monotonic on both sides and symmetrical with respect to the barrel center.

The superposition function can also be formed by a polynomial function, a trigonometric function, a circular function or a power function.

In a particular embodiment, the contour is formed in accordance with the equations $$R_U(x, c) = R_0 + A * \sin\left(\frac{2 * \varphi * (x + c)}{L_{REF}}\right) - B * x - C * x^2$$

$$R_L(x, c) = R_0 - A * \sin\left(\frac{2 * \varphi * (x - c)}{L_{REF}}\right) + B * x - C * x^2$$

where $R_U$ radius of the upper supporting roll $R_L$ radius of the lower supporting roll x axial position with respect to the roll center c contour displacement $R_o$ roll radius offset A contour coefficient $\phi$ contour angle $L_{REF}$ camber reference length B tilting coefficient C second order coefficient (C>0).

The square term $C*x^2$ brings about a superposition of a parabolic contour with the trigonometric contour found in rolls which are mentioned in the Background and known in conventional systems. If the coefficient C were zero, the two adjacent rolls supplement one another again in a complementary manner in the load-free, non-displaced state.

FIG. 1 is a schematic illustration showing the upper part of a four-high rolling stand having supporting rolls in a non-loaded, non-displaced state, according to an exemplary embodiment (the part of the four-high rolling stand lying thereunder is only indicated by dashed lines). The working rolls 1, 1' and the supporting rolls 2, 2' have a barrel contour which is described by a trigonometric function. Proceeding from a first contour function 7, which is supplemented in a complementary manner with the contour of the working roll 1 in a non-loaded state, the contour function 10 of the supporting roll 2 is obtained by superposing the first contour function 7 with a superposition function 8 or 8'. This superposition function 8 or 8' is shown at the top of the diagram in the illustration of FIG. 1. In the exemplary embodiment shown, the superposition function 8 is concave in relation to the supporting roll axis 9. According to certain embodiments, the concave superposition function 8 is subtracted from the first contour function 7. The result is the contour 5 of the supporting roll 2, which is indicated by dashed lines in FIG. 1 and is described by the contour function 10 (the same applies to the case of the convex superposition function 8', which, according to another embodiment, is added to the contour function 7).

The result of this superposition is an additional camber of the supporting roll 2 in the region of the barrel center 4. This profile form can easily be gathered from the graphic illustration of FIG. 1. Proceeding from the barrel center 4, a progressively increasing gap is formed to the left and right between the supporting roll 2 and the working roll 1.

Figure 2:
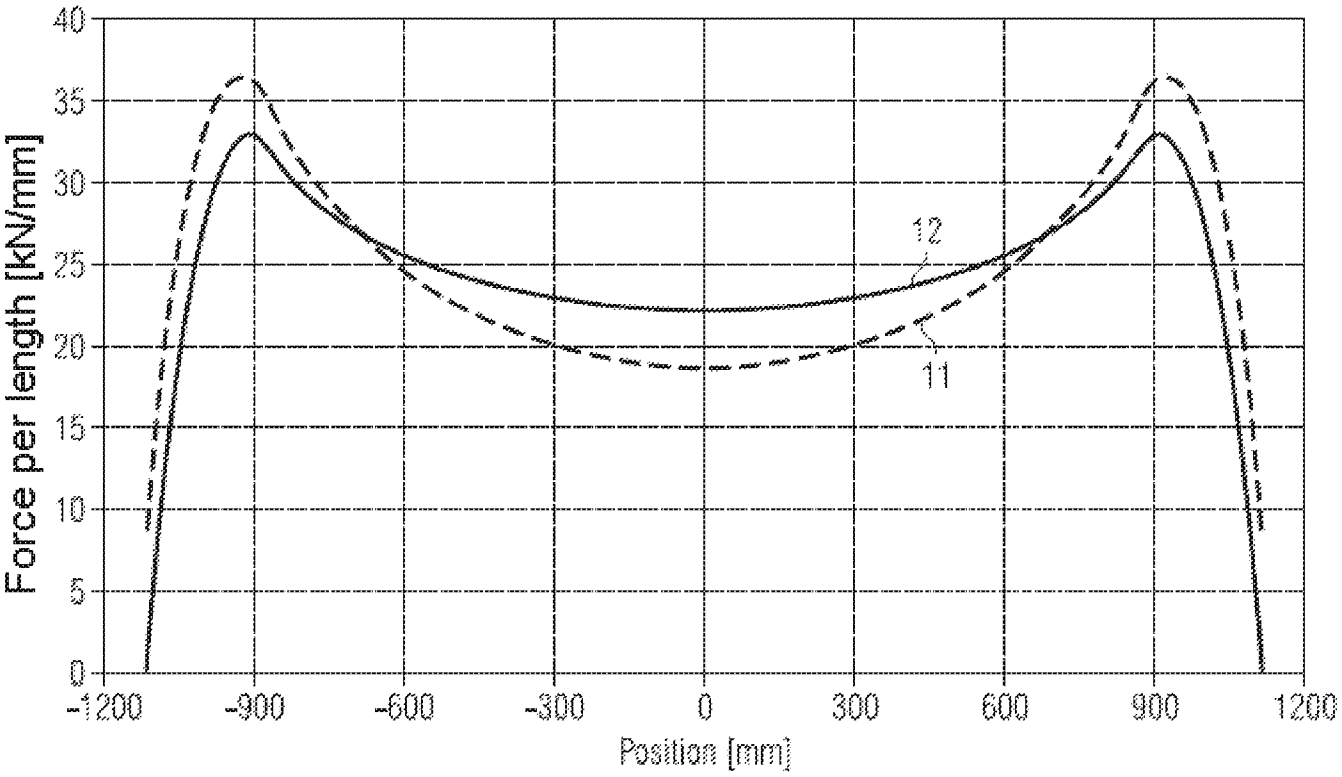
FIG. 2 is a graph showing a calculated load distribution between an upper working roll and a supporting roll depending on the position in relation to the center of the stand, where curve 12 represents the case with the curvature of the supporting roll according to embodiments disclosed herein and curve 11 represents the case without the curvature.

The effect of the supplementation of the barrel contour is explained below on the basis of FIG. 2. FIG. 2 is a graph showing a calculated load distribution between a working roll 1 and a supporting roll 2. Here, the position in relation to the center of the rolling stand is plotted on the abscissa, and the force with reference to the unit of length is plotted on the ordinate. The curve 11 shows the load distribution for the case of completely supplementary roll cambers, in which case the contour of the working roll and the supporting roll is described by a trigonometric function as mentioned in the Background. By contrast, curve 12 shows the load distribution for the case of a contour function 10 of the supporting roll 2, formed as disclosed herein. This contour function 10 proceeded from a superposition of the known trigonometric contour function 7 with a function—in the present example a square function. As is clearly apparent from FIG. 2, the load is transferred toward the center of the roll.

The graphic illustration of the result of the calculation clearly shows that, even in the case of wide rolling stands having supporting rolls which have been deliberately cambered in the center, load peaks can be reduced and the load distribution can be made more uniform.

This equalization of the load distribution provided by the techniques disclosed herein may increase the roll life and the risk of cracking or even roll breakages may be reduced.

The effect of the equalization of the load distribution is of course not limited to the four-high rolling stand mentioned above, but instead also leads to a reduction of load peaks and to equalization of the load profile in the case of the load distribution between intermediate rolls and supporting rolls in a six-high rolling stand.

What is claimed is:

1. A rolling stand for producing a rolled strip, comprising:

a plurality of rolls comprising working rolls supported on at least one of (a) one or more supporting rolls and (b) one or more intermediate rolls, wherein:

at least some of the plurality of rolls are axially moveable relative to one another, and for a pair of rolls including a particular supporting roll and another roll of the plurality of rolls, the other roll of the plurality of rolls being adjacent to the particular supporting roll, each roll of the pair of rolls is configured to have a cross-section taken along a central longitudinal axis of the roll with a surface of the roll having a curved contour with respect to the central longitudinal axis of the roll that runs over an entire effective barrel length in a non-loaded state of the pair of rolls, the particular supporting roll is configured to have a contour predefined by a contour function formed from a superposition of (a) a first contour function that runs in a manner complementary to an adjacent working roll in a non-loaded state of the particular supporting roll and the adjacent working roll and in a non-displaced state of the particular supporting roll and the adjacent working roll where the particular supporting roll and the adjacent working roll are not displaced axially relative to one another with (b) a superposition function that is concave or convex in relation to a rotational axis of the particular supporting roll in the non-loaded state and in the non-displaced state of the particular supporting roll and the adjacent working roll, the superposition function having a nonzero value at least along the entire length of the particular supporting roll except for a center of the entire length of the particular supporting roll, the particular supporting roll has a first barrel end and a second barrel end and the adjacent working roll has a first barrel end and a second barrel end, in the non-displaced state of the particular supporting roll and the adjacent working roll, the first barrel end of the particular supporting roll is configured not to be aligned with the first barrel end of the adjacent working roll or the second barrel end of the adjacent working roll and the second barrel end of the particular supporting roll is configured not to be aligned with the first barrel end of the adjacent working roll or the second barrel end of the adjacent working roll, and the first contour function is formed from contour portions which are alternately concavely and convexly curved, along the rotational axis of the particular supporting roll, and wherein the contour function is defined by a trigonometric function.

2. The rolling stand of claim 1, wherein the superposition function is a concave superposition function, and wherein the contour function of the particular supporting roll is formed by subtraction of the concave superposition function from the first contour function.

3. The rolling stand of claim 1, wherein the superposition function is a convex superposition function, and wherein the contour function of the particular supporting roll is formed by addition of the convex superposition function to the first contour function.

4. The rolling stand of claim 1, wherein the superposition function is formed by a function that is monotonic on both sides and symmetrical with respect to a barrel center.

5. The rolling stand of claim 1, wherein the superposition function is formed by a trigonometric function.

6. The rolling stand of claim 1, wherein the contour of the supporting roll has a marginal chamfer in a marginal region of the particular supporting roll.

7. The rolling stand of claim 1, wherein the contour of the particular supporting roll, in the non-loaded state and in the non-displaced state of the particular supporting roll and the adjacent working roll, is such that an increasing gap between the particular supporting roll and the adjacent working roll is formed as a distance from the center of the entire length of the particular supporting roll increases.

8. The rolling stand of claim 1, wherein the inclusion of the superposition function in the contour function of the particular supporting roll makes the pressure distribution between the supporting roll and the adjacent working roll more uniform than if the superposition function was not included in the contour function of the particular supporting roll.

9. A rolling stand for producing a rolled strip, comprising:

a plurality of rolls comprising working rolls supported on at least one of (a) one or more supporting rolls and (b) one or more intermediate rolls, wherein:

at least some of the plurality of rolls are axially moveable relative to one another, and for a pair of rolls including a particular supporting roll and another roll of the plurality of rolls, the other roll of the plurality of rolls being adjacent to the particular supporting roll, each roll of the pair of rolls is configured to have a cross-section taken along a central longitudinal axis of the roll with a surface of the roll having a curved contour with respect to the central longitudinal axis of the roll that runs over an entire effective barrel length in a non-loaded state of the pair of rolls, the particular supporting roll is configured to have a contour predefined by a contour function formed from a superposition of (a) a first contour function that runs in a manner complementary to an adjacent working roll in a non-loaded state of the particular supporting roll and the adjacent working roll and in a non-displaced state of the particular supporting roll and the adjacent working roll where the particular supporting roll and the adjacent working roll are not displaced axially relative to one another with (b) a superposition function that is concave or convex in relation to a rotational axis of the particular supporting roll in the non-loaded state and in the non-displaced state of the particular supporting roll and the adjacent working roll, the superposition function having a nonzero value at least along the entire length of the particular supporting roll except for a center of the entire length of the particular supporting roll, the particular supporting roll has a first barrel end and a second barrel end and the adjacent working roll has a first barrel end and a second barrel end, in the non-displaced state of the particular supporting roll and the adjacent working roll, the first barrel end of the particular supporting roll is configured not to be aligned with the first barrel end of the adjacent working roll or the second barrel end of the adjacent working roll and the second barrel end of the particular supporting roll is configured not to be aligned with the first barrel end of the adjacent working roll or the second barrel end of the adjacent working roll, and the first contour function is formed from contour portions which are alternately concavely and convexly curved, along the rotational axis of the particular supporting roll, and wherein the contour function is defined by a polynomial function.

10. The rolling stand of claim 9, wherein the superposition function is formed by a polynomial function.

11. The rolling stand of claim 9, wherein the superposition function is a concave superposition function, and wherein the contour function of the particular supporting roll is formed by subtraction of the concave superposition function from the first contour function.

12. The rolling stand of claim 9, wherein the superposition function is a convex superposition function, and wherein the contour function of the particular supporting roll is formed by addition of the convex superposition function to the first contour function.

13. The rolling stand of claim 9, wherein the superposition function is formed by a function that is monotonic on both sides and symmetrical with respect to a barrel center.

14. The rolling stand of claim 9, wherein the contour of the supporting roll has a marginal chamfer in a marginal region of the particular supporting roll.

15. The rolling stand of claim 9, wherein the contour of the particular supporting roll, in the non-loaded state and in the non-displaced state of the particular supporting roll and the adjacent working roll, is such that an increasing gap between the particular supporting roll and the adjacent working roll is formed as a distance from the center of the entire length of the particular supporting roll increases.

16. The rolling stand of claim 9, wherein the inclusion of the superposition function in the contour function of the particular supporting roll makes the pressure distribution between the supporting roll and the adjacent working roll more uniform than if the superposition function was not included in the contour function of the particular supporting roll.

17. A rolling stand for producing a rolled strip, comprising:

a plurality of rolls comprising working rolls supported on at least one of (a) one or more supporting rolls and (b) one or more intermediate rolls, wherein:

at least some of the plurality of rolls are axially moveable relative to one another, and for a pair of rolls including a particular supporting roll and another roll of the plurality of rolls, the other roll of the plurality of rolls being adjacent to the particular supporting roll, each roll of the pair of rolls is configured to have a cross-section taken along a central longitudinal axis of the roll with a surface of the roll having a curved contour with respect to the central longitudinal axis of the roll that runs over an entire effective barrel length in a non-loaded state of the pair of rolls, the particular supporting roll is configured to have a contour predefined by a contour function formed from a superposition of (a) a first contour function that runs in a manner complementary to an adjacent working roll in a non-loaded state of the particular supporting roll and the adjacent working roll and in a non-displaced state of the particular supporting roll and the adjacent working roll where the particular supporting roll and the adjacent working roll are not displaced axially relative to one another with (b) a superposition function that is concave or convex in relation to a rotational axis of the particular supporting roll in the non-loaded state and in the non-displaced state of the particular supporting roll and the adjacent working roll, the superposition function having a nonzero value at least along the entire length of the particular supporting roll except for a center of the entire length of the particular supporting roll, the particular supporting roll has a first barrel end and a second barrel end and the adjacent working roll has a first barrel end and a second barrel end, in the non-displaced state of the particular supporting roll and the adjacent working roll, the first barrel end of the particular supporting roll is configured not to be aligned with the first barrel end of the adjacent working roll or the second barrel end of the adjacent working roll and the second barrel end of the particular supporting roll is configured not to be aligned with the first barrel end of the adjacent working roll or the second barrel end of the adjacent working roll, and the contour of the particular supporting roll is formed in accordance with the equation:

$$R_U(x, c) = R_0 + A * \sin\left(\frac{2 * \varphi * (x + c)}{L_{REF}}\right) - B * x - C * x^2$$

$$R_L(x, c) = R_0 - A * \sin\left(\frac{2 * \varphi * (x - c)}{L_{REF}}\right) + B * x - C * x^2$$

where $R_U$ radius of the upper supporting roll $R_L$ radius of the lower supporting roll x axial position with respect to the roll center c contour displacement $R_o$ roll radius offset A contour coefficient ϕ contour angle $L_{REF}$ camber reference length B tilting coefficient C second order coefficient (C>0).

18. The rolling stand of claim 17, wherein the superposition function is formed by a power function.

19. The rolling stand of claim 17, wherein the superposition function is a concave superposition function, and wherein the contour function of the particular supporting roll is formed by subtraction of the concave superposition function from the first contour function.

20. The rolling stand of claim 17, wherein the superposition function is a convex superposition function, and wherein the contour function of the particular supporting roll is formed by addition of the convex superposition function to the first contour function.

21. The rolling stand of claim 17, wherein the superposition function is formed by a function that is monotonic on both sides and symmetrical with respect to a barrel center.

22. The rolling stand of claim 17, wherein the superposition function is formed by a polynomial function.

23. The rolling stand of claim 17, wherein the superposition function is formed by a trigonometric function.

24. The rolling stand of claim 17, wherein the contour of the supporting roll has a marginal chamfer in a marginal region of the particular supporting roll.

25. The rolling stand of claim 17, wherein the contour of the particular supporting roll, in the non-loaded state and in the non-displaced state of the particular supporting roll and the adjacent working roll, is such that an increasing gap between the particular supporting roll and the adjacent working roll is formed as a distance from the center of the entire length of the particular supporting roll increases.

26. The rolling stand of claim 17, wherein the inclusion of the superposition function in the contour function of the particular supporting roll makes the pressure distribution between the supporting roll and the adjacent working roll more uniform than if the superposition function was not included in the contour function of the particular supporting roll.

* * * * *